US008646153B2

(12) United States Patent
Nagami

(10) Patent No.: US 8,646,153 B2
(45) Date of Patent: Feb. 11, 2014

(54) HINGE MECHANISM, AND MONITOR OPENING AND CLOSING MECHANISM

(75) Inventor: Tetsuro Nagami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/581,352

(22) PCT Filed: Jun. 7, 2010

(86) PCT No.: PCT/JP2010/003786

§ 371 (c)(1),
(2), (4) Date: Aug. 27, 2012

(87) PCT Pub. No.: WO2011/154988

PCT Pub. Date: Dec. 15, 2011

(65) Prior Publication Data

US 2012/0317751 A1 Dec. 20, 2012

(51) Int. Cl.
*E05D 11/10* (2006.01)

(52) U.S. Cl.
USPC ..... 16/334; 16/335

(58) Field of Classification Search
USPC ..... 16/334, 335, 336, 340, 339; 361/679.27, 679.28, 679.11, 679.12, 361/679.13, 679.15; 455/90.3, 575.1, 455/575.3, 575.8; 248/291.1, 919–923
See application file for complete search history.

(56) References Cited

U.S. PATENT DOCUMENTS

| | | | | |
|---|---|---|---|---|
| 2,201,594 | A * | 5/1940 | Sitts | 292/76 |
| 6,256,837 | B1 * | 7/2001 | Lan et al. | 16/334 |
| 6,918,159 | B2 * | 7/2005 | Choi | 16/347 |
| 7,508,656 | B2 * | 3/2009 | Okahara | 361/679.27 |
| 2010/0128458 | A1 * | 5/2010 | Nagami | 361/825 |
| 2011/0154616 | A1 * | 6/2011 | Nagami | 16/333 |
| 2011/0239405 | A1 * | 10/2011 | Nagami | 16/277 |
| 2012/0036680 | A1 * | 2/2012 | Nagami | 16/297 |

FOREIGN PATENT DOCUMENTS

| | | | |
|---|---|---|---|
| JP | 56-159587 | | 11/1981 |
| JP | 57-80724 | | 5/1982 |
| JP | 2-167974 | A | 6/1990 |
| JP | 2-113015 | U | 9/1990 |
| JP | 10280781 | A * | 10/1998 |
| JP | 2000-55031 | A | 2/2000 |
| JP | 2002-39160 | A | 2/2002 |
| JP | 2006-105275 | A | 4/2006 |
| KR | 2003042619 | A * | 6/2003 |
| WO | WO 2010092640 | A1 * | 8/2010 |

* cited by examiner

*Primary Examiner* — Chuck Mah
(74) *Attorney, Agent, or Firm* — Birch, Stewart, Kolasch & Birch, LLP.

(57) ABSTRACT

A plate spring 40 is subjected to folding at a fold portion 41 to form integrally a plate spring portion 42 and a stress relief portion 43*m* and a distal end of a rotary shaft 30 is secured to a caulking hole of the stress relief portion 43 by caulking.

5 Claims, 6 Drawing Sheets

HINGE MECHANISM, AND MONITOR OPENING AND CLOSING MECHANISM

TECHNICAL FIELD

The present invention relates to a hinge mechanism coupling a monitor to a monitor device to be opened and closed freely, and a monitor opening and closing mechanism.

BACKGROUND ART

There is a rotary attachment mechanism disclosed in Patent Document 1 as one example of a conventional hinge mechanism having a clicking action. The rotary attachment mechanism has a shaft that passes through a base, a clicking spring, and a clicking plate, and the clicking plate is secured to the shaft. The clicking spring is a plate spring having resiliency in a direction parallel to the central axis of the shaft, and a protrusion for a clicking function to be fit into a recess of the clicking plate is formed in the position corresponding to the curved top of the clicking plate. In addition, vertically bent ends are provided on the clicking spring, and the ends are engaged with engaging holes formed in the base, so that the base and the clicking spring are fixed in an arrangement to be fit into the holes with a slight play. When the shaft rotates, the clicking plate rotates with the shaft, and the protrusion of the clicking spring fits in or comes out of the recess of the clicking plate, thereby generating a clicking action.

When the shaft rotates, the clicking spring is pushed in the rotating direction by the dimension of play, and further twisted in the rotating direction by the friction between the clicking spring and clicking plate, with the result that the ends of the clicking spring lift up from the base. Therefore, there is a problem such that the moment when the protrusion of the clicking spring is fitted into the recess in the clicking plate, the clicking spring and the clicking plate collide against each other by the released spring force of the clicking spring, whereby a very large sound of the collision (clicking sound) is generated.

On the other hand, caulking is commonly used for fastening a plate spring with a shaft to generate a rotation torque as is employed in a conventional hinge mechanism. However, caulking directly the shaft to the plate spring may cause a stress to be concentrated at the caulked portion when the plate spring is deflected, which may loosen the caulking. Moreover, a high load cannot be obtained since there is no holding member on the side toward which the spring is deflected. Therefore, conventionally, a fastening plate is laminated on the side toward which the spring is deflected, and then the fastening plate and the shaft are arranged by caulking; thus, a stress where the plate spring is deflected is dispersed to the fastening plate to prevent loosening of the caulked portion, and also the plate spring can be deflected outside the fastening plate to thus obtain a high load.

PRIOR ART DOCUMENTS

Patent Documents

Patent Document 1: Japanese Patent Application Laid-open No. 2000-55031

SUMMARY OF THE INVENTION

In the conventional hinge mechanism, there is a problem such that a gap produced between the plate spring and the shaft causes rotational play. Because of this, there occurs a problem such that a rotary member secured to the shaft is shaken when vibration is applied thereto.

In order to prevent the occurrence of a gap between the plate spring and the shaft, there is a method such that the plate spring is press-fitted in the shaft; however, a required press-fitting work deteriorates assemblability thereof; thus, it is necessary to control stringently a dimensional accuracy between the hole in the plate spring for press-fitting the shaft therein, and the shaft diameter of the shaft.

The present invention is made to solve the aforementioned problems, and an object of the invention is to provide a hinge mechanism to prevent the occurrence of rotational play, and a monitor opening and closing mechanism in which the hinge mechanism is applied to a monitor device.

A hinge mechanism of the invention includes: a shaft part forming a rotary shaft; a base part for pivotally supporting the shaft part to be rotatable, and having one of a recess and a boss for click on the circumference around the rotating shaft; a plate spring portion for rotating integrally with the shaft part, and having the other of the recess and boss for click to be fit into the one of the recess and boss for click provided to the base part; and a stress relief portion for rotating integrally with the shaft part with holding the plate spring portion between the stress relief portion and the base part, and pressing the plate spring portion against the base part, wherein the plate spring portion and the stress relief portion are formed such that the same member is subjected to folding, and one of the plate spring portion and the stress relief portion is fastened to the shaft part by caulking.

According to the invention, since the plate spring portion and the stress relief portion are formed such that the same member is subjected to folding, and one of the plate spring portion and the stress relief portion is fastened to the shaft part by caulking, the plate spring portion and the stress relief portion are united with the shaft part to be thus rotated without play. Thus, a hinge mechanism to prevent the occurrence of rotational play can be provided.

Further, a monitor opening and closing mechanism of the invention includes a monitor, a monitor device, and the hinge mechanism described above coupling openably and closably the monitor to the monitor device.

According to the invention, since the monitor opening and closing mechanism is configured with the hinge mechanism to prevent the occurrence of rotational play, shaking of the monitor caused by rotational play can be suppressed.

BEST MODE FOR CARRYING OUT THE INVENTION

In the following, embodiments of the present invention will be discussed with reference to the accompanying drawings to explain the present invention in more detail.

Embodiment 1

Hereinafter, a hinge mechanism according to Embodiment 1 of the present invention will be described with reference to one example that is applied to a monitor opening and closing mechanism coupling openably and closably a monitor to a monitor device.

Figure 1:
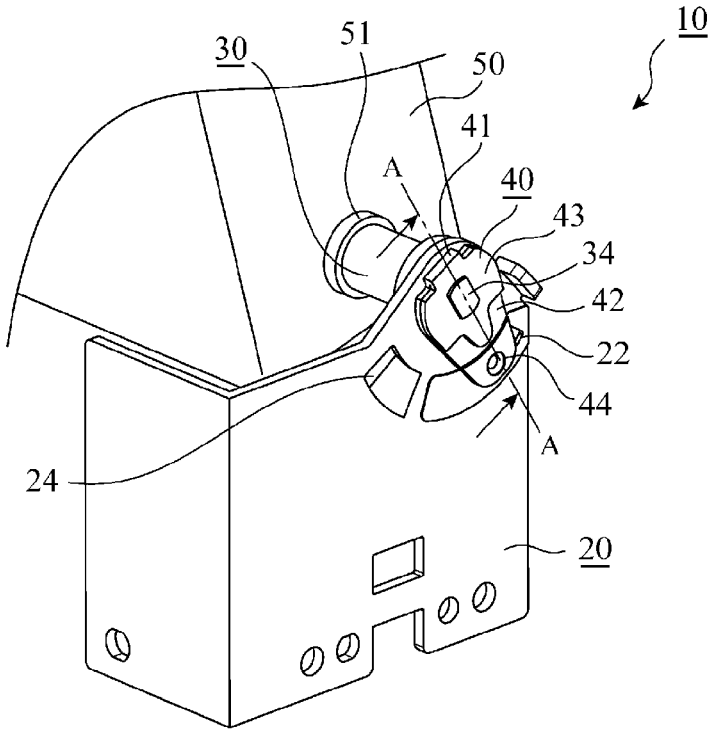
FIG. 1 is an external perspective view illustrating the structure of a hinge mechanism according to Embodiment 1 of the present invention.
Figure 2:
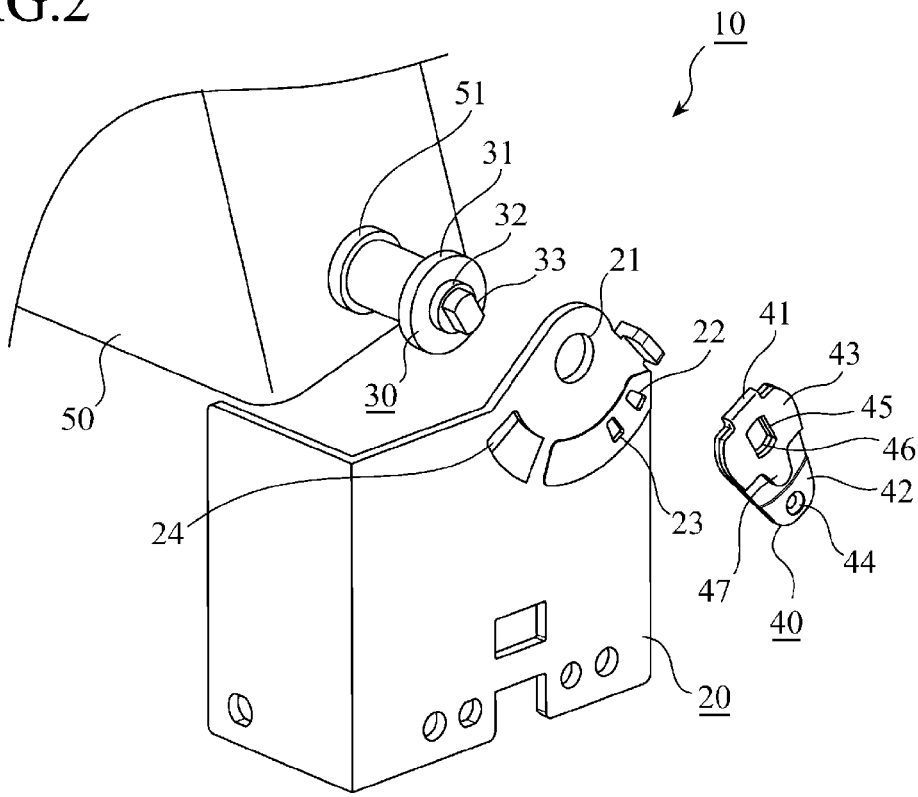
FIG. 2 is an exploded perspective view of the hinge mechanism according to Embodiment 1.

FIG. 1 is an external perspective view illustrating the structure of a hinge mechanism 10 coupled to a rotation center shaft part 51 when a monitor 50 is opened and closed, and FIG. 2 shows an exploded perspective view. The hinge mechanism 10 is composed of a base 20, a rotary shaft 30, and a plate spring 40; the base 20 is fastened to the monitor device side (not shown), while the rotation center shaft part 51 of the monitor 50 is coupled to the rotary shaft 30. FIG. 1 and FIG. 2 illustrate only one rotation center shaft part 51 on one side of the monitor 50; however, a hinge mechanism (not shown) that has the same configuration as the hinge mechanism 10, and that is symmetrical with respect to a plane vertical to the rotary shaft is coupled to the other rotation center shaft part 51 to thus open and close the monitor 50 relative to the monitor device.

A rotary shaft hole 21, and a plurality of recesses for click 22, 23, and 24 on the circumference around the rotary shaft hole 21 are provided in the base 20. A cylindrical portion 32 of the rotary shaft 30 is inserted into the rotary shaft hole 21 to be pivotally supported to be rotatable.

Figure 3:
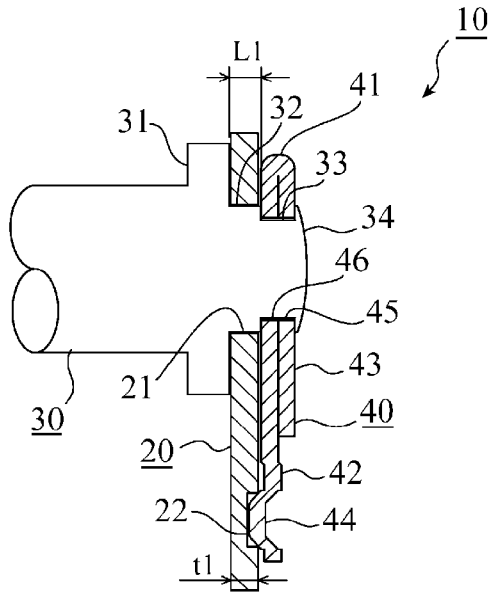
FIG. 3 is a cross-sectional view of the hinge mechanism according to Embodiment 1 taken along the line A-A shown in FIG. 1.

FIG. 3 shows a cross-sectional view of the hinge mechanism 10 taken along the line A-A of FIG. 1. As shown in FIG. 3, provided on one end side of the rotary shaft 30 are a flange 31 having a larger diameter than a hole diameter of the rotary shaft hole 21; the cylindrical portion 32 (length of the cylindrical portion $L1=t1+\alpha$) that has a shaft diameter that is smaller by the extent of fit than a hole diameter of the rotary shaft hole 21 and that is somewhat longer than the thickness (t1) of the base 20; and an inserted portion 33 having a shaft diameter smaller than (or the same shaft diameter as) that of the cylindrical portion 32 and cut in the shape of letter I. Further, the distal end of the inserted portion 33 is caulked to form a caulked portion 34.

On the other hand, the monitor 50 is secured to the other end side of the rotary shaft 30, as shown in FIG. 1 and FIG. 2.

Figure 4A:
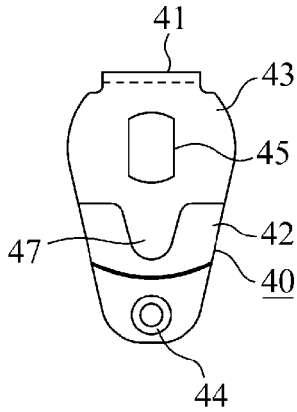
FIG. 4A is a front view illustrating the configuration of a plate spring in the hinge mechanism according to Embodiment 1.
Figure 4B:
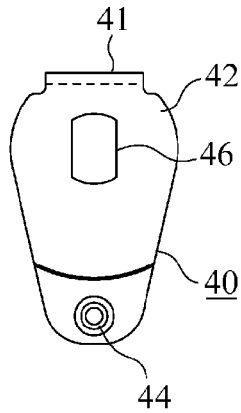
FIG. 4B is a rear view illustrating the configuration of the plate spring in the hinge mechanism according to Embodiment 1.

As shown in FIG. 3, the plate spring 40 has a double-fold structure in which the same member is subjected to folding in the position of a fold portion 41 and folded back tightly, one part forming a plate spring portion 42 and the other part forming a stress relief portion 43. As shown in the front view of FIG. 4A and the rear view of FIG. 4B, the plate spring portion 42 is provided with a boss for click 44 that fits into the recesses for click 22, 23, and 24 of the base 20 to retain the monitor 50 at a certain rotation angle position, and a fitting hole 46 to be fit in with the inserted portion 33 of the rotary shaft 30 inserted therein. The stress relief portion 43 of the other part is provided with a caulking hole 45 in which the distal end of the rotary shaft 30 is fastened by caulking, and a tongue 47. The caulking hole 45 and the fitting hole 46 each have an I shape corresponding to the outer shape of the inserted portion 33 of the rotary shaft 30, and have an area larger by the extent of fit than the cross section of the inserted portion 33.

In the assembly of the hinge mechanism 10, the inserted portion 33 and the cylindrical portion 32 of the rotary shaft 30 are passed in turn through the rotary shaft hole 21 of the base 20, and the inserted portion 33 is further passed through the fitting hole 46 and caulking hole 45 of the plate spring 40, and the distal end of the inserted portion 33 is caulked with the caulking hole 45 of the stress relief portion 43. As a result, as shown in FIG. 3, the stress relief portion 43 of the plate spring 40 is securely fastened by the thickness of the inserted portion 33 crushed by caulking (caulked portion 34), and further the plate spring portion 42 is pressed down, so that the rotary shaft 30 is surely fastened to the plate spring 40. In such a way, even though there is a gap of the extent of fit between the inserted portion 33 and the fitting hole 46, no play is caused between the rotary shaft 30 and the plate spring portion 42. Since the plate spring portion 42 and the stress relief portion 43 are formed integrally, the number of components is reduced and assemblability thereof is enhanced.

When the monitor 50 rotates, in synchronization with the rotation, the rotary shaft 30 and the plate spring 40 rotate about the rotary shaft hole 21 of the base 20. The boss for click 44 of the plate spring portion 42 slides with pressing the surface of the base 20 by the resilient force of the stress relief portion 43 and the plate spring portion 42 to generate a rotating torque. Further, the boss for click 44 of the plate spring portion 42 produces a clicking action by fitting in and coming out of the recesses for click 22, 23, and 24 of the base 20.

When the boss for click 44 is come out of the recesses for click 22, 23, and 24, it slides in a manner to push up the plate spring portion 42 from the surface of the base 20, and therefore the plate spring portion 42 deflects during the slide. Following the deflected plate spring portion 42, the stress relief portion 43 also presses thereon by the surface thereof with deflecting, and disperses the stress concentrated on the plate spring portion 42 with pressing on the surface thereof. Thus, loosening of the caulked portion can be prevented. In addition, the tongue 47 relieves the stress to be concentrated at the outer edges of the stress relief portion 43 upon deflection of the plate spring portion 42 to thus prevent the plate spring portion 42 from breaking at the outer edges of the stress relief portion 43. Further, the formation of the stress relief portion 43 provides a higher spring property as compared with a plate spring 40 formed with only the plate spring portion 42.

Moreover, since the rotary shaft 30 is fastened to the stress relief portion 43 by caulking, and the plate spring portion 42 integral with the stress relief portion 43 rotates synchronously with the rotary shaft 30 without play, there is no play in the rotating direction of the plate spring 40. Thus, generation of an impact sound caused by release of the spring force, and vibration of the monitor 50 can be prevented.

As described above, according to Embodiment 1, the hinge mechanism 10 is configured by including: a rotary shaft 30 forming a rotating shaft; a base 20 for rotatably supporting the rotary shaft 30 passed through a rotary shaft hole 21 and having recesses for click 22, 23, and 24 formed on the circumference about the rotating shaft; a plate spring portion 42 for rotating integrally with the rotary shaft 30 and having a boss for click 44 to be fit into the recesses for click 22, 23, and 24 formed in the base 20; and a stress relief portion 43 for rotating integrally with the rotary shaft 30 with holding the plate spring portion 42 between the stress relief portion and the base 20 and pressing the plate spring portion against the base 20, wherein the plate spring portion 42 and the stress relief portion 43 are formed such that the same member is subjected to folding, the distal end of the rotary shaft 30 is passed through a caulking hole 45 in the stress relief portion 43 and fastened thereto by caulking, and the rotary shaft 30 is fitted into the fitting hole 46 of the plate spring portion 42. For this reason, the stress relief portion 43 that is one part of the plate spring 40 is secured to the rotary shaft 30 by caulking to be rotated together, and the plate spring portion 42 that is the other part rotates integrally with the stress relief portion 43 without play, thereby preventing the play in the rotating direction of the plate spring 40. Additionally, since the number of components thereof is reduced, there is an advantage such that the efficiency of assembling work thereof is enhanced.

Moreover, according to Embodiment 1, since it is configured that the monitor 50 is coupled openably and closably to a monitor device with the hinge mechanism 10, shaking of the monitor 50 caused by rotational play can be suppressed.

Embodiment 2

Figure 5:
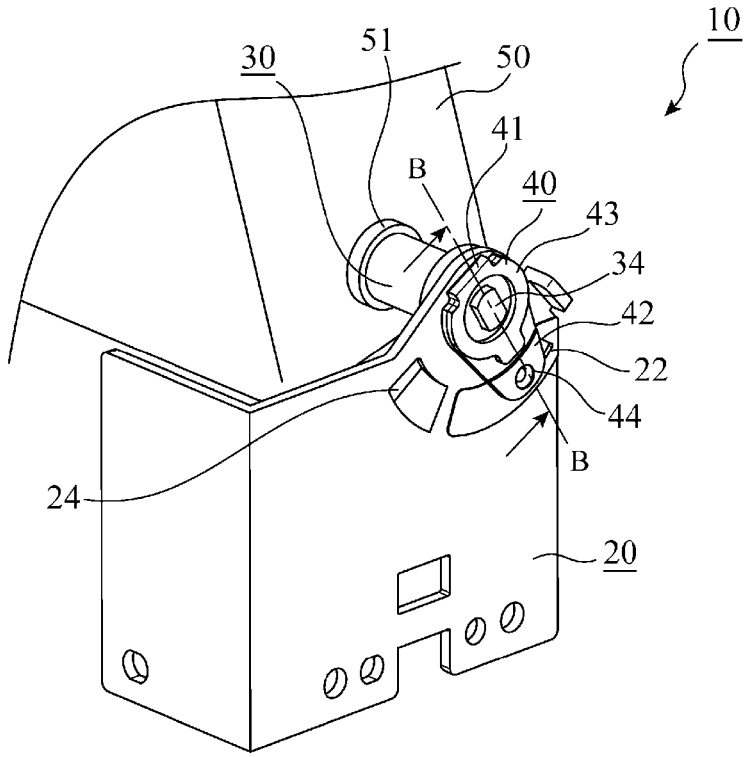
FIG. 5 is an external perspective view illustrating the structure of a hinge mechanism according to Embodiment 2 of the invention.
Figure 6:
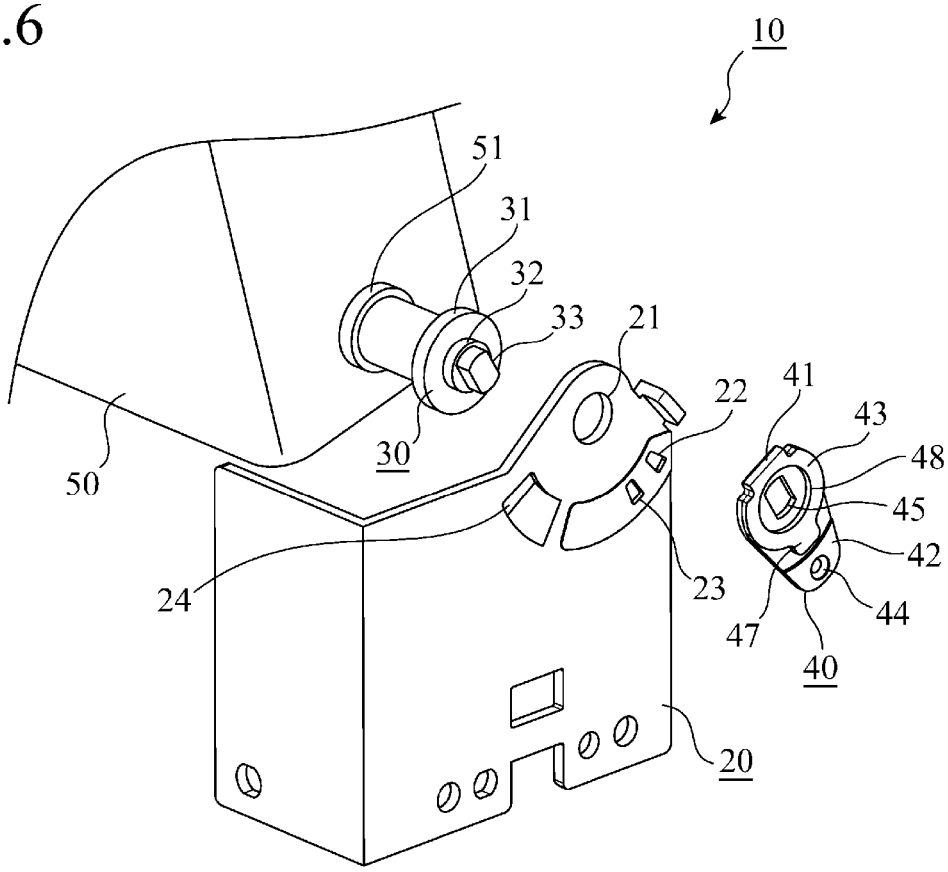
FIG. 6 is an exploded perspective view of the hinge mechanism according to Embodiment 2.
Figure 7:
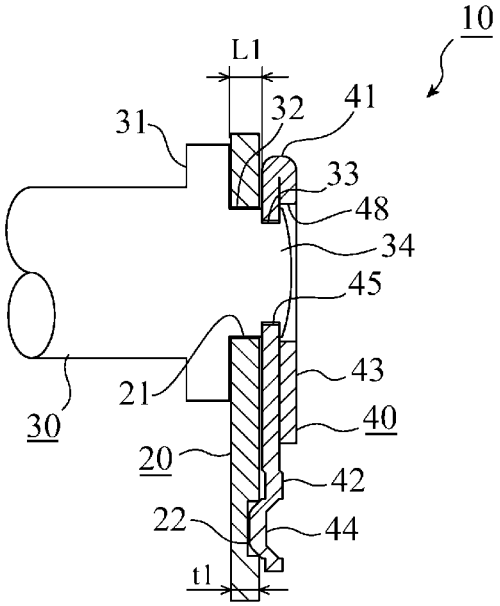
FIG. 7 is a cross-sectional view of the hinge mechanism according to Embodiment 2 taken along the line B-B shown in FIG. 5.
Figure 8A:
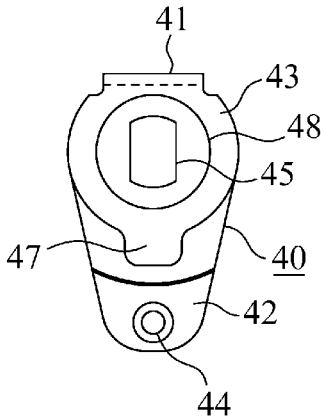
FIG. 8A is a front view illustrating the configuration of a plate spring in the hinge mechanism according to Embodiment 2.
Figure 8B:
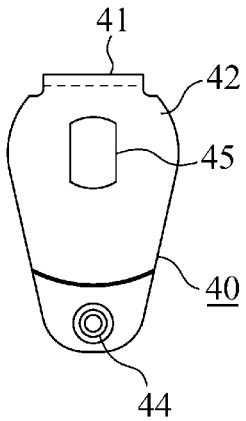
FIG. 8B is a rear view illustrating the configuration of the plate spring in the hinge mechanism according to Embodiment 2.

FIG. 5 is an external perspective view illustrating the structure of a hinge mechanism 10 according to Embodiment 2, and FIG. 6 shows an exploded perspective view. FIG. 7 shows a cross-sectional view of the hinge mechanism 10 taken along the line B-B shown in FIG. 5. Furthermore, FIG. 8A and FIG. 8B show a front view and a rear view, respectively, illustrating the configuration of a plate spring 40 of Embodiment 2. Parts in FIG. 5 to FIG. 8B that are the same or equivalent to those of FIG. 1 to FIG. 4B are denoted by the same reference numerals, and explanations thereof will be omitted.

The plate spring 40 has a double-fold structure in which the same member is subjected to folding in the position of a fold portion 41 and folded back tightly, as in Embodiment 1 described above. Note that the caulking hole 45 for securing the distal end of the rotary shaft 30 by caulking is provided not in the stress relief portion 43 but in the plate spring portion 42. Further, when the distal end of the rotary shaft 30 is caulked to the caulking hole 45 of the plate spring portion 42, the stress relief portion 43 is provided with an caulking-escape hole 48 of an extent such that a caulking tool (not shown) is not hindered.

In the assembly of the hinge mechanism 10, the inserted portion 33 and the cylindrical portion 32 of the rotary shaft 30 are passed in turn through the rotary shaft hole 21 of the base 20, and the inserted portion 33 is further passed through the caulking hole 45 of the plate spring 40; further, a caulking tool is inserted through the caulking-escape hole 48, and the distal end of the inserted portion 33 is caulked with the plate spring portion 42. As a result, as shown in FIG. 7, since the plate spring portion 42 of the plate spring 40 is fastened by the thickness of the inserted portion 33 crushed by caulking (caulked portion 34), when the plate spring portion 42 rotates synchronously with the rotary shaft 30 without play, and the stress relief portion 43 also rotates integrally without play.

Therefore, during rotation of the monitor 50, when the boss for click 44 slides on the surface of the base 20 and then the plate spring portion 42 is put in a deflected situation, the stress relief portion 43 also deflects with conforming to the plate spring portion 42, so that stress concentration thereof is dispersed around the caulking hole 45 of the plate spring portion 42 and to the fold portion 41. Thus, loosening of the caulked portion can be prevented. In addition, the tongue 47 relieves the stress to be concentrated at the outer edges of the stress relief portion 43 upon deflection of the plate spring portion 42 to thus prevent the plate spring portion 42 from breaking at the outer edges of the stress relief portion 43. Further, the formation of the stress relief portion 43 provides a higher spring property as compared with a plate spring 40 formed with only the plate spring portion 42. The spring property, however, is weaker than that of Embodiment 1 described above, since the stress relief portion 43 is not fastened to the rotary shaft 30.

Moreover, since the rotary shaft 30 and the plate spring portion 42 are secured to each other by caulking, the plate spring 40 rotates synchronously with the rotary shaft 30 without play. Thus, there is no play in the rotating direction of the plate spring 40; generation of an impact sound caused by release of the spring force, and vibration of the monitor 50 can be prevented.

Furthermore, even if the center axes of the caulking-escape hole 48 in the stress relief portion 43, and the caulking hole 45 in the plate spring portion 42 are slightly misaligned with each other, since the caulking-escape hole 48 is formed large enough, the inserted portion 33 of the rotary shaft 30 can be inserted without difficulty into the caulking-escape hole 48 and the caulking hole 45 of the plate spring 40. Thus, assemblability of the hinge mechanism 10 is enhanced. Additionally, since an accuracy in coaxiality between the caulking-escape hole 48 and the caulking hole 45 is unnecessary, productivity of the plate spring 40 is enhanced.

As described above, according to Embodiment 2, it is configured as follows: the plate spring portion 42 and the stress relief portion 43 of the hinge mechanism 10 are formed such that the same member is subjected to folding, the distal end of the rotary shaft 30 is passed through the caulking hole 45 of the spring plate portion 42 and fastened thereto by caulking, and the stress relief portion 43 is provided with a caulking-escape hole 48 to be inserted thereinto by a caulking tool such that the distal end of the rotary shaft 30 is secured to the caulking hole 45 by caulking. For this reason, the plate spring portion 42 that is one part of the plate spring 40 is secured to the rotary shaft 30 by caulking to be rotated together without play, thereby preventing the play in the rotating direction of the plate spring 40. Additionally, there are advantageous effects such that the number of components is reduced, and that assembling efficiency of the hinge mechanism 10 is enhanced because the rotary shaft 30 can be inserted without difficulty even if the center axes of the caulking hole 45 in the plate spring portion 42, and the caulking-escape hole 48 in the stress relief portion 43 are slightly misaligned with each other. Further, there is also an advantageous effect such that since an accuracy in coaxiality between the caulking hole 45 and the caulking-escape hole 48 is unnecessary, productivity of the plate spring 40 is increased.

Moreover, according to Embodiment 2, since it is configured that the monitor 50 is coupled openably and closably to a monitor device with the hinge mechanism 10, shaking of the monitor 50 caused by rotational play can be suppressed.

Embodiment 3

Figure 9:
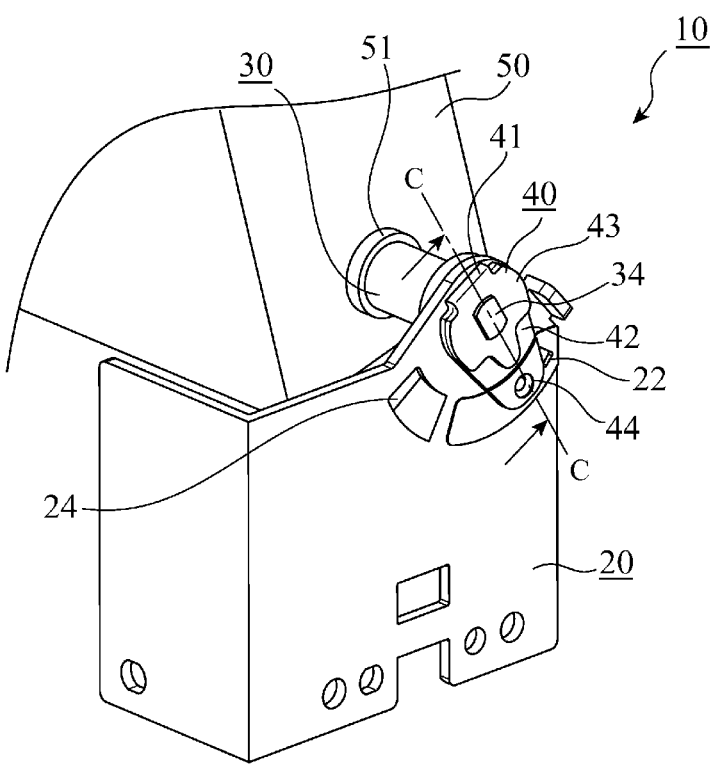
FIG. 9 is an external perspective view illustrating the structure of a hinge mechanism according to Embodiment 3 of the invention.
Figure 10:
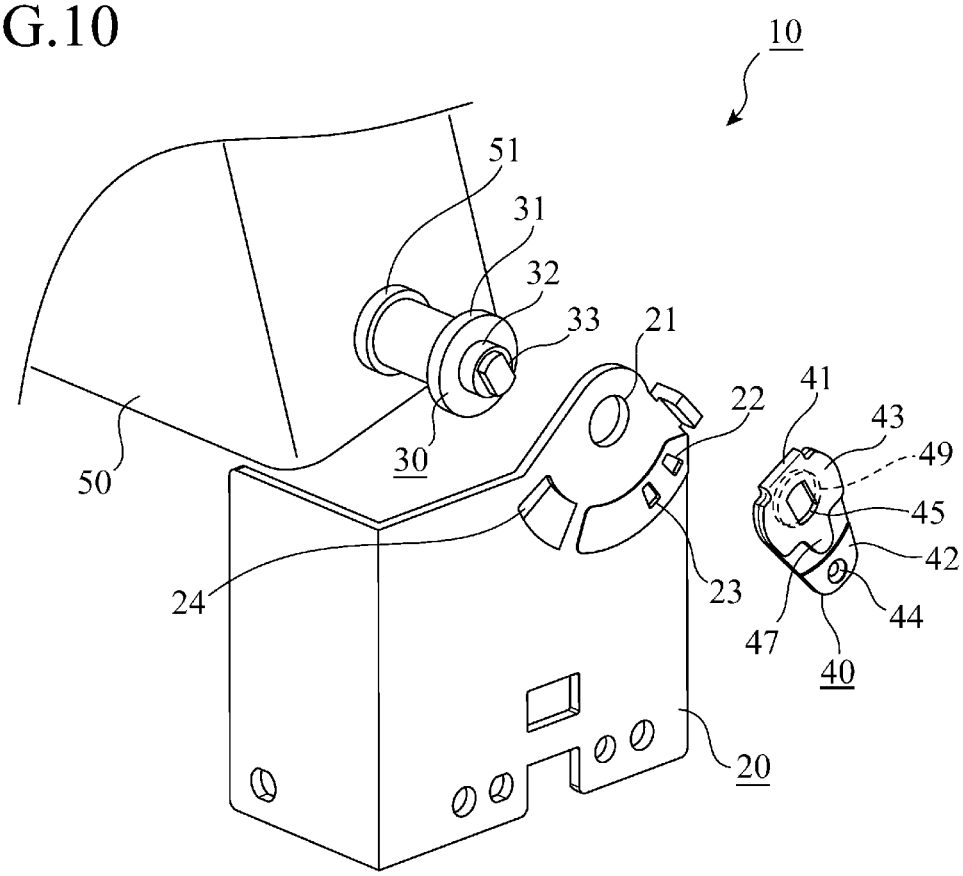
FIG. 10 is an exploded perspective view of the hinge mechanism according to Embodiment 3.
Figure 11:
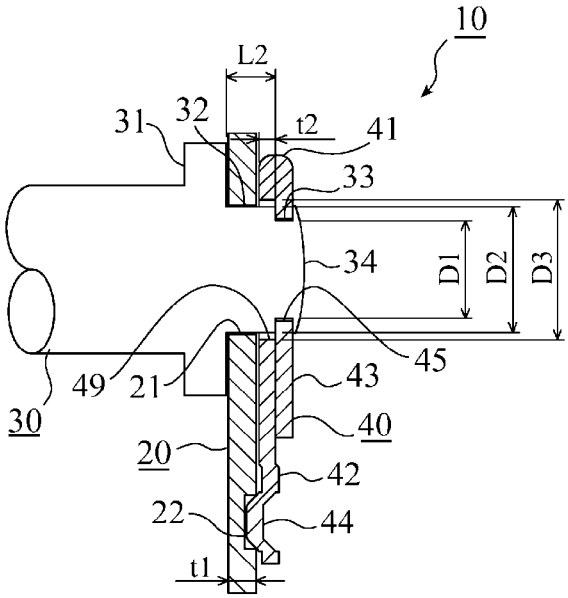
FIG. 11 is a cross-sectional view of the hinge mechanism according to Embodiment 3 taken along the line C-C shown in FIG. 9.
Figure 12A:
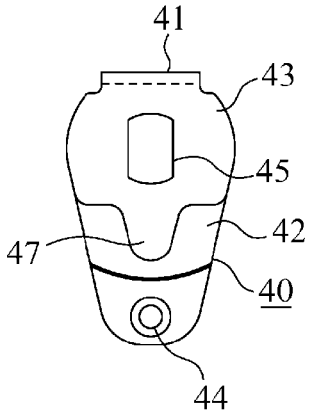
FIG. 12A is a front view illustrating the configuration of a plate spring in the hinge mechanism according to Embodiment 3.
Figure 12B:
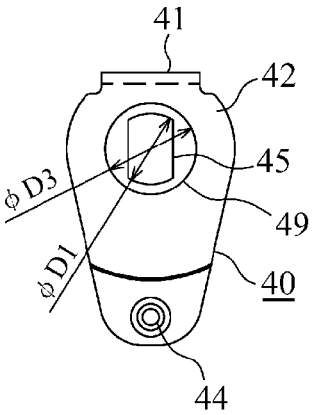
FIG. 12B is a rear view illustrating the configuration of the plate spring in the hinge mechanism according to Embodiment 3.

FIG. 9 is an external perspective view illustrating the structure of a hinge mechanism 10 according to Embodiment 3, and FIG. 10 shows an exploded perspective view. FIG. 11 shows a cross-sectional view of the hinge mechanism 10 taken along the line C-C of FIG. 9. Further, FIG. 12A and FIG. 12B show a front view and a rear view, respectively, illustrating the configuration of a plate spring 40 of Embodiment 3. Parts in FIG. 9 to FIG. 12B that are the same or equivalent to those of FIG. 1 to FIG. 4B are denoted by the same reference numerals, and explanations thereof will be omitted.

As in Embodiment 1 described above, the rotary shaft 30 has a flange 31, a cylindrical portion 32, and an inserted portion 33 at one end thereof, while the monitor 50 is secured to the other end thereof. Note that the cylindrical portion 32 has a length somewhat longer than the sum of the thickness (t1) of the base 20 and the thickness (t2) of the plate spring portion 42 of the plate spring 40 (length of the cylindrical portion $L2=t1+t2+\alpha$).

As in Embodiment 1 described above, the plate spring 40 has a double-fold structure in which the same member is subjected to folding in the position of a fold portion 41 and folded back tightly. Note that the plate spring portion 42 is provided with an insertion hole 49 for insertion of the cylindrical portion 32, instead of the fitting hole 46 in which the inserted portion 33 of the rotary shaft 30 is fit. The insertion hole 49 has a diameter (ϕD3) larger than the diameter (ϕD1) of the caulking hole 45 of the stress relief portion 43 and also larger than the shaft diameter (ϕD2) of the cylindrical portion 32 of the rotary shaft 30 to thus prevent a contact between the cylindrical portion 32 and the insertion hole 49 upon rotation of the rotary shaft 30.

In the assembly of the hinge mechanism 10, the inserted portion 33 and the cylindrical portion 32 of the rotary shaft 30 are passed in turn through the rotary shaft hole 21 of the base 20 and the insertion hole 49 of the plate spring 40, and further the inserted portion 33 is passed through the caulking hole 45 of the plate spring 40, and then the distal end of the inserted portion 33 is caulked with the caulking hole 45 of the stress relief portion 43. As a result, as shown in FIG. 11, the stress relief portion 43 of the plate spring 40 is caulking-fastened by the thickness of the inserted portion 33 crushed by the caulking (caulked portion 34); thus, when the stress relief portion 43 rotates synchronously with the rotary shaft 30, the plate spring portion 42 also rotates integrally.

Since there is a gap between the cylindrical portion 32 of the rotary shaft 30 and the insertion hole 49 of the plate spring 40, when a vibration is applied thereto, the plate spring portion 42 and the stress relief portion 43 are twisted to each other, which gives a damping effect, so that the vibration is less likely to be transmitted to the monitor 50. Thus, vibration of the monitor 50 can be prevented.

Moreover, since the insertion hole 49 of the plate spring 40 is formed larger than the caulking hole 45 of the stress relief portion 43, even if the center axes of the insertion hole 49 and the caulking hole 45 are slightly misaligned with each other, the rotary shaft 30 can be inserted without difficulty, so that assemblability of the hinge mechanism 10 is enhanced. Also, since an accuracy in coaxiality between the insertion hole 49 and the caulking hole 45 is unnecessary, productivity of the plate spring 40 is enhanced.

Furthermore, since the rotary shaft 30 and the stress relief portion 43 are secured to each other by caulking, the plate spring 40 rotates synchronously with the rotary shaft 30 without play. Thus, there is no play in the rotating direction of the plate spring 40; generation of an impact sound caused by release of the spring force, and vibration of the monitor 50 can be prevented.

As described above, according to Embodiment 3, it is configured as follows: the plate spring portion 42 and the stress relief portion 43 of the hinge mechanism 10 are formed such that the same member is subjected to folding, the distal end of the rotary shaft 30 is passed through the caulking hole 45 in the stress relief portion 43 and fastened thereto by caulking, and the rotary shaft 30 is passed through the insertion hole 49 of the plate spring portion 42. For this reason, the stress relief portion 43 that is one part of the plate spring 40 is caulking-secured to the rotary shaft 30 to be rotated together, and the plate spring portion 42 that is the other part rotates integrally with the stress relief portion 43 without play, thereby preventing the play in the rotating direction of the plate spring 40. Additionally, there are advantageous effects such that the number of components is reduced, and that assembling efficiency of the hinge mechanism 10 is enhanced because the rotary shaft 30 can be inserted without difficulty even if the center axes of the insertion hole 49 in the plate spring portion 42, and the caulking hole 45 in the stress relief portion 43 are slightly misaligned with each other. Further, there is also an advantageous effect such that since an accuracy in coaxiality between the caulking hole 45 and the insertion hole 49 is unnecessary, productivity of the plate spring 40 is increased.

Moreover, according to Embodiment 3, since it is configured that the monitor 50 is coupled openably and closably to a monitor device with the hinge mechanism 10, shaking of the monitor 50 caused by rotational play can be suppressed. Further, when vibration is applied thereto, the plate spring portion 42 and the stress relief portion 43 are twisted to each other to give a damping effect; thus, the vibration is less likely to be transmitted to the monitor 50, thereby suppressing vibration of the monitor 50 more effectively.

INDUSTRIAL APPLICABILITY

As described above, since the hinge mechanism of the present invention prevents the rotational play, it is suitable for use in a monitor opening and closing mechanism for opening and closing a monitor and so on that are more likely subjected to vibration, for example, a vehicle-mounted overhead monitor device.

The invention claimed is:

1. A hinge mechanism, comprising:

a shaft part forming a rotary shaft;

a base part pivotally supporting the shaft part, and having one of a recess and a boss on a circumference around the rotating shaft for click engagement;

a plate spring fastened to the shaft part for rotating integrally with said shaft part, said plate spring including a plate spring portion having the other of the recess and the boss to be selectively fitted into the one of the recess and boss for click engagement; a stress relief portion holding the plate spring portion between the stress relief portion and the base part, and pressing the plate spring portion against the base part, and wherein the plate spring is folded back along a fold portion to form the plate spring portion and the stress relief portion such that the plate spring portion and the stress relief portion tightly press against each other, and one of the plate spring portion and the stress relief portion is fastened to the shaft part by caulking.

2. The hinge mechanism according to claim 1, wherein the stress relief portion has a caulking hole to be passed through by a distal end of the shaft part and fastened by caulking, and the plate spring portion has a fitting hole in which the shaft part is fitted.

3. The hinge mechanism according to claim 1, wherein the plate spring portion has a caulking hole to be passed through by a distal end of the shaft part and fastened by caulking, and the stress relief portion has a caulking-escape hole that receives insertion of a caulking tool for fastening the distal end of the shaft part to the caulking hole by caulking.

4. The hinge mechanism according to claim 1, wherein the stress relief portion has a caulking hole to be passed through by a distal end of the shaft part and fastened by caulking, and the plate spring portion has an insertion hole to be passed through by the shaft part, the insertion hole having a larger diameter than a shaft diameter of the shaft part.

5. A monitor opening and closing mechanism comprising a monitor, a monitor device, and a hinge mechanism according to claim 1 coupling openably and closably the monitor to the monitor device.

* * * * *